United States Patent [19]

Levan

[11] Patent Number: 4,861,575

[45] Date of Patent: Aug. 29, 1989

[54] METHOD OF PRODUCING CARBON FIBERS BY OVERWRAPPINGS TOWS

[75] Inventor: Chris D. Levan, Brunswick, Ohio

[73] Assignee: Amoco Corporation, Chicago, Ill.

[21] Appl. No.: 860,857

[22] Filed: May 8, 1986

[51] Int. Cl.[4] ..... D01F 9/22

[52] U.S. Cl. ..... 423/447.2; 422/447.1; 422/447.4; 422/447.6; 422/447.9; 264/29.5

[58] Field of Search ..... 423/447.1, 447.2, 447.4, 423/447.6, 447.9; 264/29.5

[56] References Cited

U.S. PATENT DOCUMENTS

| | | | |
|---|---|---|---|
| 3,775,520 | 11/1973 | Ram et al. | 423/447.1 |
| 3,809,673 | 5/1974 | White et al. | 423/447.1 |
| 4,237,175 | 12/1980 | Kobayashi | 423/447.1 |
| 4,378,343 | 3/1983 | Sugiura et al. | 423/447.1 |
| 4,501,037 | 2/1985 | Lay et al. | 423/447.4 |
| 4,534,919 | 8/1985 | McAliley et al. | 423/447.4 |

FOREIGN PATENT DOCUMENTS

| | | | |
|---|---|---|---|
| 61-113826 | 5/1986 | Japan | 423/447.2 |

OTHER PUBLICATIONS

"Gemmill & Dunsmore: GDM Mk 3 Novelty Wrap-Twister", by Elwyn Griffiths, *Textile World*, Apr. 1984, pp. 44–46.

*Primary Examiner*—John Doll
*Assistant Examiner*—Robert M. Kunemund
*Attorney, Agent, or Firm*—Richard J. Schlott; William H. Magidson; Ralph C. Medhurst

[57] ABSTRACT

Carbon fibers may be made by a process comprising:

overwrapping a multifilament polyacrylonitrile tow with a thread of material to maintain the tow as an integral bundle, followed by stabilizing said tow by heating in an oxidizing atmosphere at a temperature between about 180° and about 400° C., thereby oxidizing the filaments comprising said tow, followed by carbonizing the tow thus stabilized by heating at a temperature sufficient to effect carbonization, thereby forming a carbon fiber.

The carbon fibers may be used to make reinforced composites in thermoplastic or thermosetting matrix resins, particularly prepreg.

5 Claims, 2 Drawing Sheets

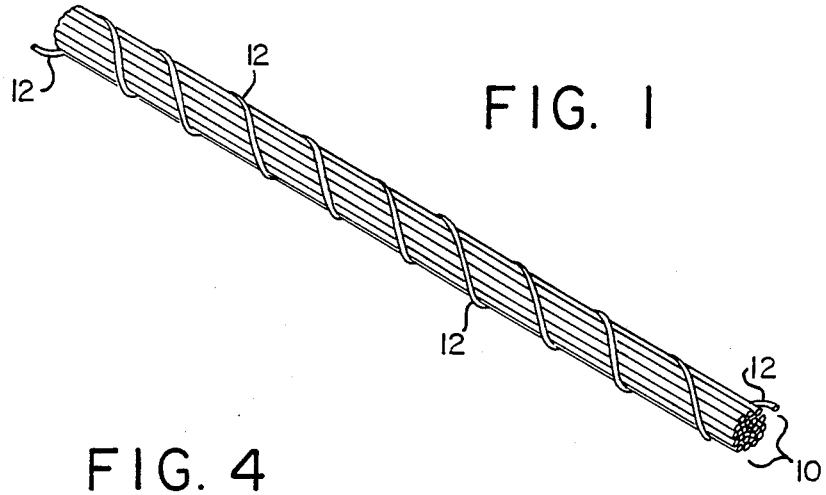
FIG. 1
FIG. 4
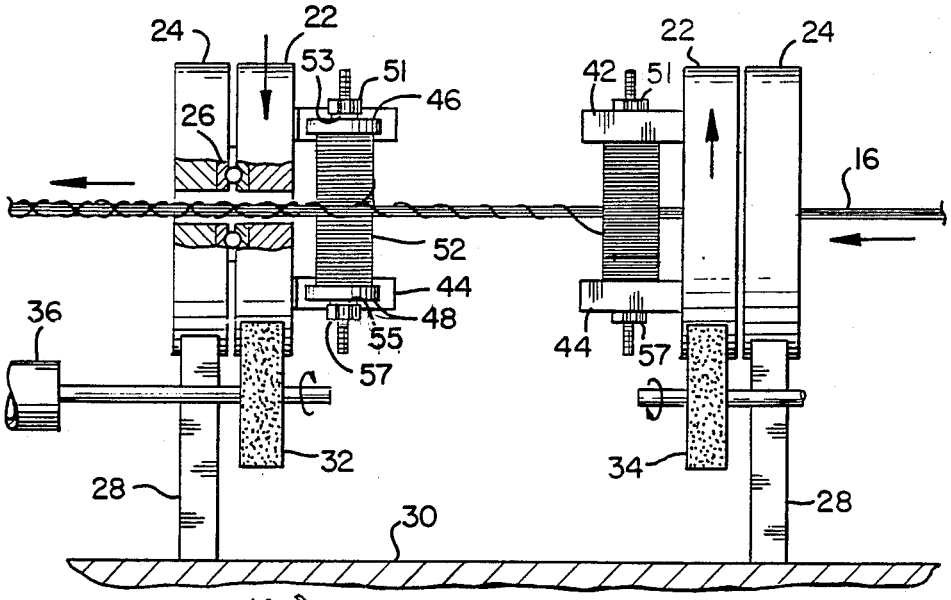
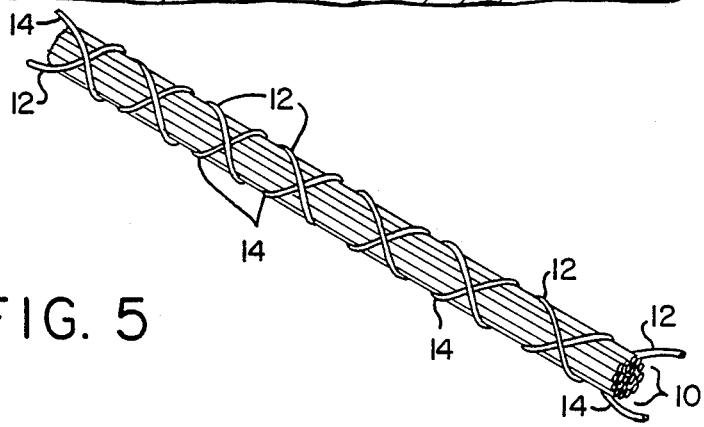
FIG. 5

METHOD OF PRODUCING CARBON FIBERS BY OVERWRAPPINGS TOWS

FIELD OF THE INVENTION

This invention relates to an improved method of making carbon fibers from polyacrylonitrile and relates in particular to a method of making carbon fibers having better visual quality and reduced fraying. The invention further relates to the improved carbon fibers per se and to composites comprising the fibers and a matrix resin.

BACKGROUND OF THE INVENTION

The use of polyacrylonitrile (PAN) to make carbon fibers is well known in the art. PAN filaments, generally in the form of multifilament tows, are treated to stabilize the filaments prior to ultimately carbonizing the tows at temperatures which usually range from about 650° to about 1650° C. The stabilization treatment involves heating multifilament tows in an oxygen-containing atmosphere at a temperature of about 180° to about 400° C. Without such a stabilization treatment the fibers which ultimately result exhibit significantly inferior physical properties, particularly tensile strength.

Prior to undergoing stabilization and carbonization, tows are generally mechanically treated to maintain the filaments comprising them as integral bundles during stabilization and carbonization. The stabilization process in particular generally involves numerous mechanical manipulations whereby tows are in physical contact with guides, rollers, and the like such that significant opportunities for damage to the tows exist. PAN tows heated in the temperature range of stabilization soften and rub or drag on the stabilization processing equipment and are damaged through the generation of breaks in individual filaments which weakens the tow or through the development of caternaries (also known as loop-outs) which cause unacceptable visual quality in the carbon fibers which ultimately result. Consequently, a standard practice is to air-interlace the tows to bundle them. Air-interlacing effects a "controlled entanglement" which is intended to prevent the filaments from splaying out during the stabilization, carbonization, or other procedures involving physical manipulation. Tows which are not integrally bundled are frequently and, sometimes, excessively damaged leading, as mentioned, to frequent wrap-ups, loop-outs, and unacceptable visual quality due to "fuzziness". However, air-interlacing itself represents a tradeoff since, by entangling the filaments within a tow, some fuzziness and other forms of damage result, even though it is their occurrence which is sought to be minimized.

An alternative to interlacing is twisting the tow to maintain it as an integral, linear bundle. Twisting, however, can also inherently damage the bundle and cause fuzziness through distortion of the filaments in the act of twisting off axis. Tows can be also damaged by breaking individual filaments therein. The twisting further imparts a permanent (twisted) set to the tows, and thus requires the tows to be untwisted. The machinery required to accomplish this is generally fairly sophisticated and very expensive. Moreover, retrofits to existing continuous carbon fiber production operations are not easily accomplished to incorporate twisting, in addition to the significant expense involved.

A method of maintaining PAN tows as integral bundles without the need to entangle the filaments therein or to twist the tows would thus be a useful addition to the art of forming carbon fibers.

BRIEF DESCRIPTION OF THE DRAWINGS

FIG. 1 is a perspective view of a multifilament tow overwrapped according to the invention.

FIG. 4 is a side view of an apparatus for overwrapping tows counterdirectionally.

FIG. 5 is a perspective view of a multifilament tow counderdirectionally overwrapped according to the invention.

THE INVENTION

Figure 2:
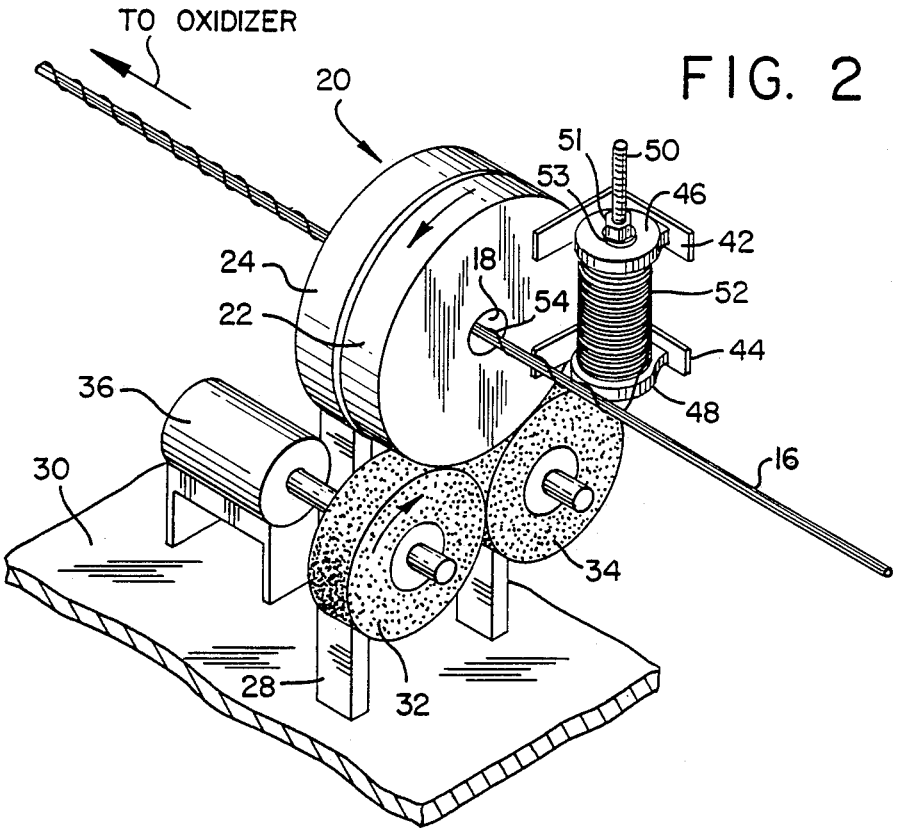
FIG. 2 is a perspective view of an apparatus for overwrapping.

The present invention provides a method of making carbon fibers, comprising the steps of:

overwrapping a multifilament polyacrylonitrile tow with a thread of material to maintain the tow as an integral bundle, followed by stabilizing said tow by heating in an oxidizing atmosphere at a temperature between about 180° and about 400° C., thereby oxidizing the filaments comprising said tow, followed by carbonizing the tow thus stabilized by heating at a temperature sufficient to effect carbonization, thereby forming a carbon fiber.

"Overwrapping" as used herein means wrapping, as a continuous spiral, at least one thread of material (herein referred to as "overwrap thread") around a tow comprised of as many filaments as desired to make a carbon fiber for substantially the entire length of the tow, said filaments typically numbering in the thousands. Overwrapping also includes embodiments wherein the tow is wrapped periodically, i.e. over discrete intervals of its length, such that substantially the same effect is achieved as if the tow had been overwrapped for its entire length.

"Oxidizing atomosphere" refers to any atmosphere containing oxygen which can be used for stabilization. Typically either air or pure oxygen are employed, although inert gas atomospheres such as argon enriched with oxygen are also feasible.

The effect of overwrapping is schematically illustrated in FIG. 1 which shows a tow comprised of many filaments collectively designated as 10 overwrapped with a single thread 12 which appears as a single continuous spiral. It will be appreciated by those skilled in the art that more than one overwrap thread may be used and that overwrapping effectively consolidates and maintains the thread as an integral bundle for as much of the tow's length as is overwrapped.

In a preferred embodiment the overwrap thread is fabricated from a precursor material, particularly a cellulosic material, which does not survive the stabilization process, preferably forming a char at a temperature between about 250° C. and about 300° C. At this point the PAN tow is sufficiently stabilized such that the chance for further damage of the type noted previously is minimal since the fibers are no longer soft and easily snagged on the processing equipment. At this point also, or later during the carbon fiber production process if desired, the char may be removed as by using a light air blast which does not affect the tow or, alternatively, by vacuuming the char from the tow. Suitable overwrap thread materials for this preferred embodiment include but are not limited to rayon fiber and cotton fiber.

Alternatively, the overwrap thread may be made from a material which survives the stabilization and is removed prior to carbonization. A suitable material for this embodiment is fiberglass, which may be removed following stabilization by using suitable unwinding equipment.

Alternatively, the overwrap thread may be fabricated from a material which survives the stabilization/carbonization process, subsequently to be removed or left in place, as desired. Suitable materials include but are not limited to PAN fiber, ceramic fiber and carbon fiber.

The overwrap thread denier is advantageously as small as practicable while still remaining capable of consolidating the tow at as high a temperature as desired. Typical deniers for thread which does not survive through stabilization/carbonization are in the range of about one-twentieth to about one-one hundredth of the denier of the filaments comprising the tow. Generally the numerical value of denier will be between about 10 and about 150.

Typical deniers for thread intended to survive stabilization/carbonization are in the range of about 10 to about 150.

The number of overwraps (i.e., the number of 360° spirals fully encircling the tow) per linear foot of tow is generally between about 10 and about 70, preferably between about 15 and about 50, and most preferably between about 20 and about 30.

Figure 3:
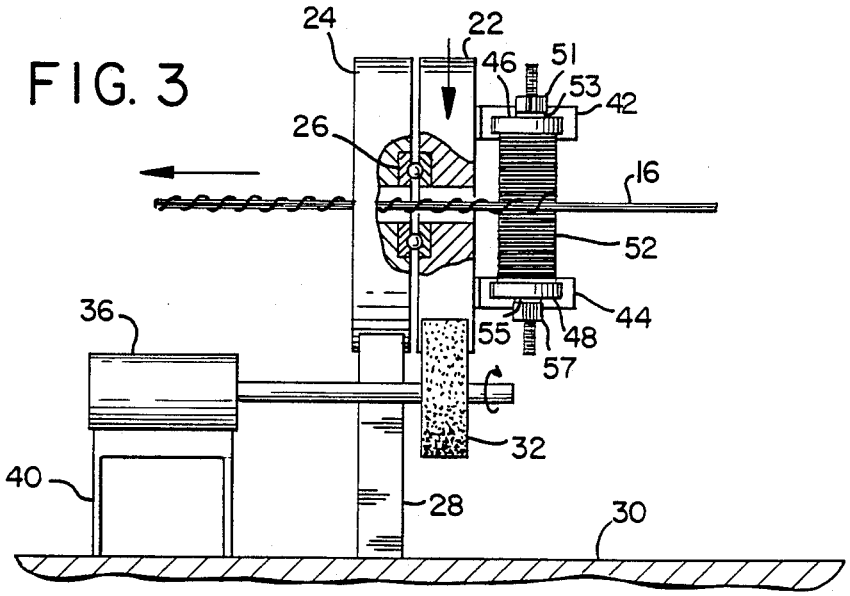
FIG. 3 is a side view of the apparatus of FIG. 2.

A suitable apparatus for winding overwrap thread around a tow of filaments is illustrated in FIGS. 2 and 3. Tow 16 is unwound from a suitable creel (not shown) or the like and fed through orifice 18 which extends through a mandrel generally designated as 20. Mandrel 20 is comprised of rotating front disc 22 rotatably connected to and journaled in stationary rear disc 24 through circular bearing 26. Disc 24 is held stationary by support stand 28 mounted on support surface 30 such as floor, benchtop, or the like. Disc 24 acts simply to spatially fix disc 22 which rotates about an axis substantially colinear and coextensive with tow 16. Drive wheels 32 and 34, powered by suitable motors 36 and 38 (not shown), supply the drive power to rotate front disc 22. Each motor is held stationary by suitable support 40 affixed to support surface 30.

Attached to the front surface of front disc 16 are brackets 42 and 44, each having a flange, 46 and 48 respectively, integral therewith. Each flange has an orifice at substantially its geometric center through which axle 50 may be removably placed substantially normal to the plane of each flange. Axle 50 serves to spatially anchor spool 52 which is, unless braked, freely rotatable about axle 50. Spool 52, of course, serves as a source of overwrap thread 54 to wind around tow 16 as it feeds through orifice 18.

Although spool 52 is freely rotatable about axle 50, axle 50 is also provided with braking means to restrain the rotation of spool 52 and thereby tension overwrap thread 54 as it is wound around tow 16. Although many braking means will be readily apparent to those skilled in the art, a useful brake may be formed by threading axle 50 so that it accepts tightening nut 51. Rubber washer 53 formed from any conventional elastomeric material (such as Neoprene rubber) is slideably moved down axle 50 until it butts up against the surface of flange 46. By suitably tightening nut 51 against washer 53 the rotation of spool 52 can be suitably retarded until thread 54 is tensioned by a desired amount of force. Suitable tension is generally in the range of 0.1–2 g of tension per unit of denier of overwrap thread 54. It will be appreciated that a similar braking device can be implemented on the opposite end of axle 50 abutting flange 48 (as by using nut 57 to tighten against washer 55, see FIG. 3), thus providing dual means to retard the rotation of spool 52.

In operation front disc 22 is rotatably driven by drive wheels 32 and 34, thus also rotating spool 52 around tow 16 as it feeds through mandrel 20 at a desired line speed. Those skilled in the art will appreciate that the line speed and/or the mandrel speed (in revolutions per minute, RPM) can each be individually manipulated to achieve a desired number of overwraps per unit length of tow while also achieving a desired throughput of overwrapped tow through the mandrel. Typical line speeds of 0.5 to about 10M/min. of overwrapped tow containing between 10 and 70 overwraps/ft. are generally quite feasible.

As indicated by the directional arrows in FIGS. 2 and 3, rotating front disc 16 has been arbitrarily designated as rotating counterclockwise. Those skilled in the art will appreciate that clockwise rotation is equally efficacious for maintaining tows as integral bundles.

In a preferred embodiment, illustrated in FIG. 4, two overwrap threads are wound in opposite directions, clockwise and counterclockwise, around a tow. FIG. 4 shows two overwrap apparatuses 50 and 52, each identical in all respects to the single overwrap apparatus shown in FIGS. 2 and 3, and the description of each need not be repeated. The two apparatuses differ solely in that the rotating front disc **16*a* of overwrap apparatus 50 rotates and applies overwrap thread in a clockwise direction, while the rotating front disc 16*b* of overwrap apparatus 52** rotates and applies overwrap thread in a counterclockwise manner.

The effect of applying two overwrap threads in such counterdirectional fashion is, in effect, to securely "cage" or "fence" the filaments in the tow, thus minimizing "loop-outs" (i.e., where one or more filaments loops off axis from the tow) and attendant fuzziness, frays, and other defects. The outermost overwrap thread further aids in locking down the inner overwrap thread.

A tow doubly overwrapped as in the above described preferred embodiment is illustrated in FIG. 5 which shows tow 10 overwrapped with first tow 12 and, counterdirectionally, with second tow 14.

The carbon fibers of this invention are well suited as reinforcement for a variety of shaped molded objects which are composites comprising the fibers in a matrix resin. Suitable matrix resins include thermoplastic resins such as:

polyetherimides described in, for example, U.S. Pat. Nos. 3,847,867, 3,838,097 and 4,107,147 and prepared by by methods well known in the art as set forth in U.S. Pat. Nos. 3,833,544, 3,887,588, 4,017,511, 3,965,125, and 4,024,110;

polyarylates prepared by any of the well known prior art polyester forming reactions, such as the reaction of the acid chlorides of aromatic dicarboxylic acids with dihydric phenols, the reaction of diaryl esters of aromatic dicarboxylic acids with dyhydric phenols, or the reaction of aromatic diacids with diester derivatives of dyhydric phenols. Such processes are described in, for example, U.S. Pat. Nos. 3,317,464, 3,948,856, 3,780,148, and 3,133,898.

polyesters formed from the reaction of an aliphatic or cyclophatic diol or mixtures thereof, containing from 2 to about 10 carbon atoms, with an aromatic dicarboxylic acid; they can be made following the teachings of, for example, U.S. Pat. Nos. 2,465,319 and 3,047,539.

poly(aryl ethers) which are linear, thermoplastic polyarylene polyethers wherein the arylene units are interspersed with other ether, sulfone or ketone linkages. These polymers may be obtained by reacting an alkali metal double salt of a dyhydric phenol and a dihalobenzenoid or dinitrobenzenoid compound, either or both of which contain a sulfone or a ketone linkage, i.e., $-SO_2-$ or $-CO-$ between arylene groupings, to provide sulfone or ketone units in the polymer chain in addition to arylene units and ether units. These polymers have the basic structure comprising recurring units of the formula:

$$-O-E-O-E'-$$

wherein E is the residuum of the dyhydric phenol and E' is the residuum of the benzenoid compound. These compounds are described, for example, in U.S. Pat. Nos. 4,108,837 and 4,175,175, both of which are herein incorporated by reference.

Also, included are other thermoplastic molding compounds such as linear polyamides and polycarbonates.

This invention further provides prepregs comprising carbon fibers as prepared according to the invention within a thermosettable matrix resin, most preferably an epoxy resi system. Prepreg is a term well known to the art as a shortened form of the term "pre-impregnated reinforcement" and is used to designate a material used as the basis for a composite such as the fibers of this invention which have been coated or impregnated with a thermosetting resin prior to assembly and cured to thermoset the impregnated resin.

Suitable epoxy resin systems are well known to the art and are made by combining an epoxy compound (i.e., any compound having two or more reactive glycidyl groups) with a suitable hardener, typically a polyamide. The epoxy resin system is ultimately cured to form the hardened epoxy.

Many epoxy compounds are commercially available for use in epoxy resin systems, including but not limited to the following, which are exemplary:

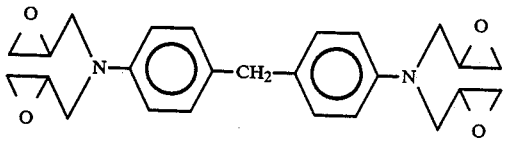

which is made by reacting an excess of epichlorohydrin with methylene diamiline; the material is available commercially as MY-720 from Ciba Geigy Corp., Ardsley, N.Y. and consists of about 70% by weight of the above tetraglycidate, the remainder being oligomers and triglycidates;

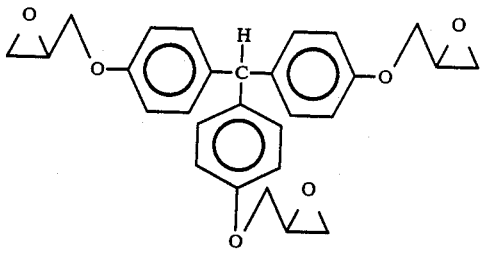

available as XD7342 from Dow Chemical;

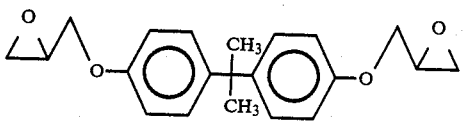

available as DER 331 from Dow Chemical or under the registered trademark EPON ® 828 from Shell; and

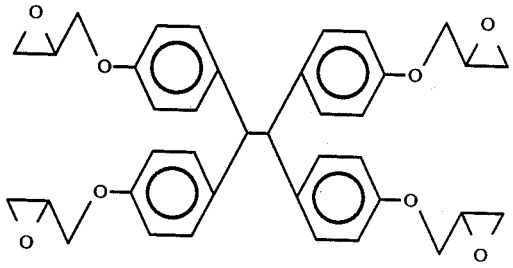

available as EPON ® 1031 from Shell.

The polyamine hardener useful in the epoxy resin system can, for example, be any of the well known aliphatic polyamines such as diethylene triamine, triethylene tetraamine, or tetraethylene pentaamine. Additional hardeners are those containing benzenoid unsaturation such as m- and p-phenylenediamine, 1,6-diaminonaphthalene, 4,4'-diaminodiphenylmethane (also known as 4,4'-methylene dianiline), 4,4'-diaminodiphenyl ether, sulfanilamide, 3-methyl-4-aminobenzamide, and 4,4'-diaminodiphenyl sulfone (DDS), 4,4'-diaminodiphenyl, ring-alkylated derivatives of m-phenylene diamine such as ETHACURE ® 100 from Ethyl Corp., Baton Rouge, LA, and the like. Another useful class of polyamine curing agents are those disclosed in U.S. Pat. No. 4,521,583, which have the formula

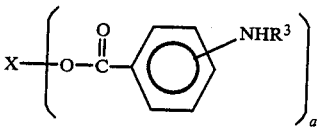

(II)

wherein a is 2 or 3, $R^3$ is hydrogen, alkyl of 1 to 8 carbon atoms or aryl of 6 to 18 carbon atoms, and X is a divalent or trivalent organic hydrocarbon, hetero-interrupted hydrocarbon, or substituted hydrocarbon radical or $-\overset{|}{N}-$.

These hardening agents may be prepared from corresponding starting materials, e.g. nitro compounds, by reduction, for example, according to methods described in U.K. Patent 1,182,377. Particularly contemplated are those compounds (II) wherein $R^3$ is hydrogen or $C_1$–$C_3$ alkyl and X is a divalent or trivalent radical selected from (1) divalent groups consisting of $-(CH_2)_y-$ wherein y is an integer of from 2 to 12,

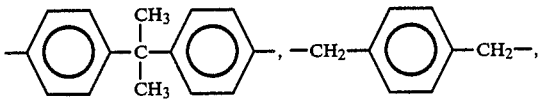

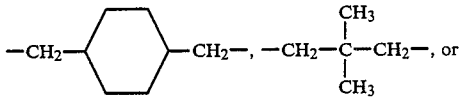

(2) trivalent groups of the formula $-\overset{|}{N}-$ and $-(CH_2)_n-\overset{|}{C}H-(CH_2)_m-$ wherein n and
m are the same or different integers from 1 to 4.

Preferred hardeners are (i) DDS, (ii) those diamines having the formula

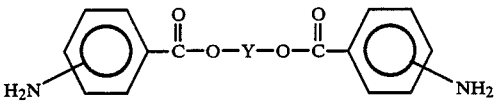

wherein each of the two amino groups is meta or para to the carbonyl group bonded to the same ring and wherein Y is $-(CH_2)_q-$ wherein q is an integer from 2 to 12, preferably 2 to 6, and most preferably 3;

(iii)

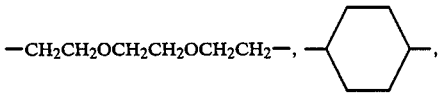

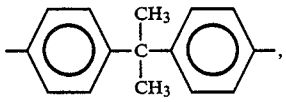

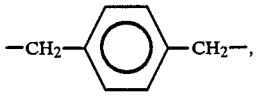

-continued

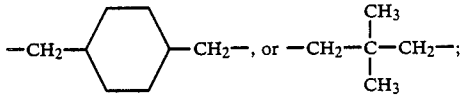

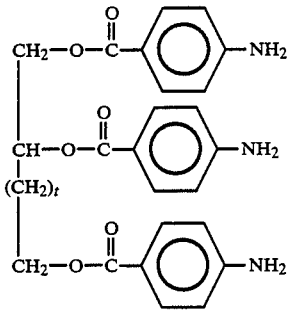

wherein t is an integer of from 0 to about 5; and (iv)

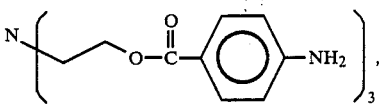

The polyamine curing agent and epoxy compound comprising an epoxy resin system are mixed essentially in an amount which provides about 0.3 to about 2.0, preferably about 0.4 to 1.7, and most preferably about 0.45 to about 1.3 moles of amine hydrogen for each mole of epoxy groups. The epoxy resin system can be cured by heating between about 200°–400° F. for time periods ranging between about 0.5 and about 12 hours.

Epoxy resin systems are prepared by heating and stirring the epoxy compound to 60° to 120° C. and adding the hardener. If the hardener is a solid, it is preferably added as a fine powder. An inert diluent such as N,N-dimethyl formamide or N-methylpyrrolidone may be used if desired. Reaction of the epoxy and hardener occur as the mixture is heated. For prepreg, the mixture is B-staged or partially reacted (i.e. typically 3 to 15 percent of the epoxy groups are reacted) in order to obtain a resin system with the required physical properties (i.e. viscosity and tack).

Prepregs according to the present invention can be made by embedding tows according to the invention into, or by coating woven or non-woven webs or rovings, made from the tows, or the like (herein referred to as "fiber reinforcement") with a curable epoxy resin system matrix which is ultimately manipulated and cured to a solid composite. Particular selection of the epoxy compound and curing agent can give a range of curable composites which can be tailored to suit a given need or application.

It is preferred to apply the resin as a hot melt to the fiber reinforcement. The B-staged epoxy resin system may conveniently first be applied to long sheets of differential release paper, i.e. paper to which a release agent such as any of several of the silicone formulations well known in the art, has been applied. In a prepreg machine, resin coated on the release paper is transferred to a web of fiber. This is done by sandwiching the web between plies of coated release paper and passing the material through a set of heated rollers. The resulting prepreg is then cooled and taken up on a spool. The total amount of resin applied to the fiber reinforcement is preferably between about 20 and about 50 wt. percent of resin solids based on the weight of the uncured composite. If desired, the prepreg may at this point be cooled to 0° F. or less by exposure to any convenient cryogenic material (such as dry ice) for shipping or storage.

Upon rewarming to about room temperature, the prepreg can then be used to make structural parts such as airplane wings or fuselage components. The prepreg may also be used to make other useful articles such as golf shafts, tennis rackets, musical instruments, satellite components, and rocket motors. To make useful articles from prepreg the prepreg may be cut into strips and then laid up (e.g. on a mold surface) to create the desired shape. The shaped, layered composite is then fully cured at pressures between about atmospheric to about 500 psi and temperatures between about 100° C. to about 300° C. in an oven, autoclave, or heated pressure mold. Depending on the exact epoxy formulation, temperature, and pressure, curing times may range between about 0.2 and about 8 hours, the optimum time, pressure, and temperature being easily ascertainable by means of trial runs. This final cure essentially C-stages the composite, meaning that the resin has substantially reached the final stage of polymerization where cross-linking becomes general and the composite is substantially infusible.

When making the epoxy resin system for use generally or for use specifically as a prepreg, a modifying thermoplastic polymer, polymer blend, or elastomer may be used to adjust the viscosity of the resin and to desirably enhance processability and mechanical properties, particularly toughness and damage tolerance. The classes of resins which are broadly useful include poly(aryl ether) resins as disclosed, for example, in U.S. Pat. Nos. 4,175,175 and 4,108,837 and exemplified by thermoplastic poly(aryl ether sulfones) available commercially under the registered trademark UDEL® from Union Carbide Corporation, polyetherimides available, for example, under the registered trademark ULTEM® from General Electric, phenoxy resins (of the type commercially available under the registered trademark UCAR® from Union Carbide Corporation), polyurethanes, butadiene/styrene/acrylonitrile terpolymers, nylons, butadiene/acrylonitrile liquid rubbers such as HYCAR® CTBN from B. F. Goodrich and the like. The amount of thermoplastic resin employed will generally fall in a range of about 1 to about 30 wt.% based on the weight of the epoxy resin system, although amounts above or below this range may be desired in certain applications. Preferred thermoplastic resins include poly(aryl ether sulfones), polyetherimides, phenoxy resins, and butadiene/acrylonitrile liquid rubbers. The thermoplastic resin is generally added to the epoxy compound and mixed therewith prior to addition of the polyamine curing agent. The modifier will often be miscible with the epoxy compound, although it will also often be occluded as a dispersion within the final cured epoxy resin once the resin is thermoset.

Co-epoxides may also be used in the epoxy resin system, that is epoxy compounds which are different from the primary epoxy compound. The co-epoxy compounds (or resins), when employed, may be present in an amount up to about 40 wt.%, preferably up to about 30wt.%, based on the amount of (cured or uncured) primary epoxy compound used.

Co-epoxy compounds which may be used herein contain two or more epoxy groups having the following formula:

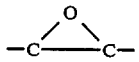

The epoxy groups can be terminal epoxy groups or internal epoxy groups. The epoxides are of two general types: polyglycidyl compounds or products derived from epoxidation of dienes or polyenes. Polyglycidyl compounds contain a plurality of 1,2-epoxide groups derived from the reaction of a polyfunctional active hydrogen containing compound with an excess of an epihalohydrin under basic conditions. When the active hydrogen compound is a polyhydric alcohol or phenol, the resulting epoxide composition contains glycidyl ether groups. A preferred group of polyglycidyl compounds are made via condensation reactions with 2,2-bis(4-hydroxyphenyl) propane, also known as bisphenol A, and have structures such as III,

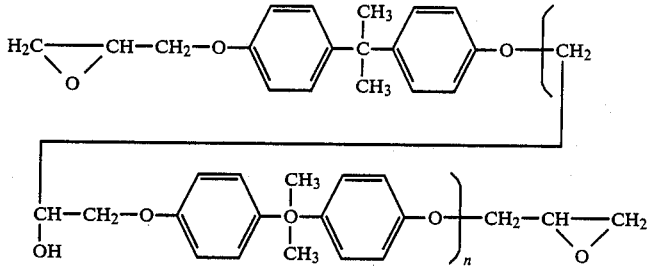

III where n has a value from about 0 to about 15. These epoxides are bisphenol-A epoxy resins. They are available commercially under the trade names such as "Epon 828," "Epon 1000", and "Epon 1009" from Shell Chemical Co. and as "DER 331", "DER 332", and "DER 334" from Dow Chemical Co. The most preferred bisphenol A epoxy resins have an "n" value between 0 and 10.

Polyepoxides which are polyglycidyl ethers of 4,4'-dihydroxydiphenyl methane, 4,4'-dihydroxydiphenyl sulfone, 4,4'-biphenol, 4,4'-dihydroxydiphenyl sulfide, phenolphthalein, resorcinol, 4,2'-biphenol, or tris(4-hydroxyphenyl) methane and the like, are useful in this invention. In addition, EPON 1031 (a tetraglycidyl derivative of 1,1,2,2-tetrakis(hydroxyphenyl)ethane from Shell Chemical Company), and Apogen 101, (a methylolated bisphenol A resin from Schaefer Chemical Co.) may also be used. Halogenated polyglycidyl compounds such as D.E.R. 542 (a brominated bisphenol A epoxy resin from Dow Chemical Company) are also useful. Other suitable epoxy resins include polyepoxides prepared from polyols such as pentaerythritol, glycerol, butanediol or trimethylolpropane and an epihalohydrin.

Polyglycidyl derivatives of phenol-formaldehyde novolaks such as IV where n=0.1 to 8 and cresol-formaldehyde novolaks such as V where n=0.1 to 8 are also useful.

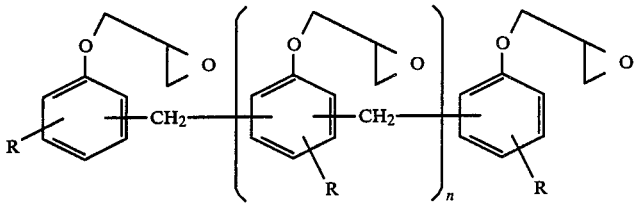

IV R = H

V R = $CH_3$

The former are commercially available as D.E.N. 431, D.E.N. 438, and D.E.N. 485 from Dow Chemical Company. The latter are available as, for example, ECN 1235, ECN 1273, and ECN 1299 (obtained from Ciba-Geigy Corporation, Ardsley, NY). Epoxidized novolaks made from bisphenol A and formaldehyde such as SU-8 (obtained from Celanese Polymer Specialties Company, Louisville, KY) are also suitable.

Other polyfunctional active hydrogen compounds besides phenols and alcohols may be used to prepare the polyglycidyl adducts useful in this invention. They include amines, aminoalcohols and polycarboxylic acids.

Adducts derived from amines include N,N-diglycidyl aniline, N,N-diglycidyl toluidine, N,N,N',N'-tetraglycidylxylylene diamine, (i.e., VI) N,N,N',N'-tetraglycidyl-bis(methylamino)cyclohexane (i.e. VII), N,N,N',N'-tetraglycidyl-4,4'-methylene dianiline, (i.e. VIII) N,N,N',N'-tetraglycidyl-3,3'-diaminodiphenyl sulfone, and N,N'-dimethyl-N,N'-diglycidyl-4,4'-diaminodiphenyl methane. Commercially available resins of this type include Glyamine 135 and Glyamine 125 (obtained from F.I.C. Corporation, San Francisco, CA.), Araldite MY-720 (obtained from Ciba Geigy Corporation) and PGA-X and PGA-C (obtained from The Sherwin-Williams Co., Chicago, Ill.).

VI

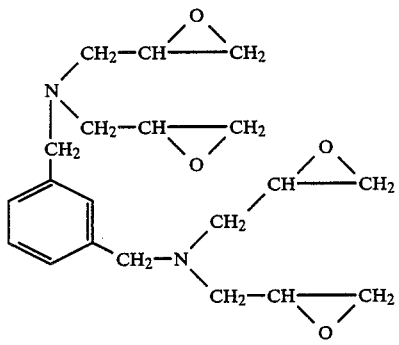

VII

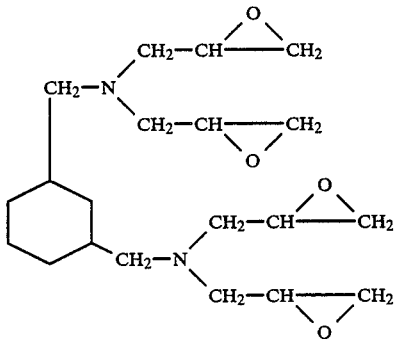

VIII

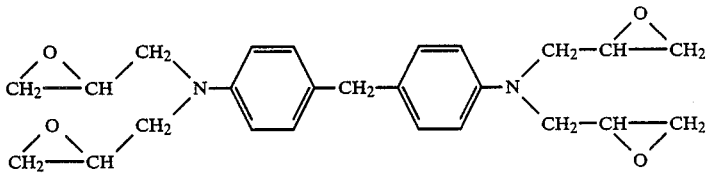

Suitable polyglycidyl adducts derived from aminoalcohols include O,N,N-triglycidyl-4-aminophenol, available as Araldite 0500 or Araldite 0510 (obtained from Ciba Geigy Corporation) and O,N,N-triglycidyl-3-aminophenol (available as Glyamine 115 from F.I.C. Corporation).

Also suitable for use herein are the glycidyl esters of carboxylic acids. Such glycidyl esters include, for example, diglycidyl phthalate, diglycidyl terephthalate, diglycidyl isophthalate, and diglycidyl adipate. There may also be used polyepoxides such as triglycidyl cyanurates and isocyanurates, N,N-diglycidyl oxamides, N,N'-diglycidyl derivatives of hydantoins such as "XB 2793" (obtained from Ciba Geigy Corporation), diglycidyl esters of cycloaliphatic dicarboxylic acids, and polyglycidyl thioethers of polythiols.

Other epoxy-containing materials are copolymers of acrylic acid esters of glycidol such as glycidyl acrylate and glycidyl methacrylate with one or more copolymerizable vinyl compounds. Examples of such copolymers are 1:1 styrene-glycidyl methacrylate, 1:1 methyl methacrylate-glycidyl acrylate and 62.5:24:13.5 methyl methacrylate:ethyl acrylate:glycidyl methacrylate.

Silicone resins containing epoxy functionality, e.g., 2,4,6,8,10-pentakis[3-(2,3-epoxypropoxy)propyl]-2,4,6,8,10-pentamethylcyclopentasiloxane and the diglycidyl ether of 1,3-bis-(3-hydroxypropyl)tetramethyldisiloxane) are also usable.

The second group of epoxy resins is prepared by epoxidation of dienes or polyenes. Resins of this type include bis(2,3-epoxycyclopentyl)ether, IX,

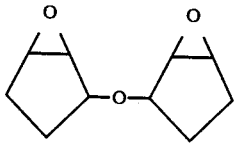

IX

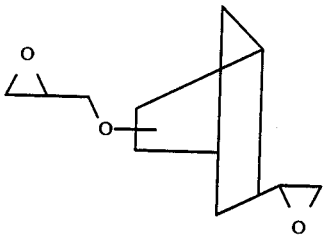

X copolymers of IX with ethylene glycol which are described in U.S. Pat. No. 3,398,102, 5(6)-glycidyl-2-(1,2-epoxyethyl)bicyclo[2.2.1]heptane, X, and dicyclopentadiene diepoxide. Commercial examples of these epoxides include vinycyclohexene dioxide, e.g., "ERL-4206" (obtained from Union Carbide Corp.), 3,4-epoxycyclohexylmethyl 3,4-epoxycyclohexane carboxylate, e.g., "ERL-4221" (obtained from Union Carbide Corp.), 3,4-epoxy-6-methylcyclohexylmethyl 3,4-epoxy-6-methylcyclohexane carboxylate, e.g., "ERL-4201" (obtained from Union Carbide Corp.), bis(3,4-epoxy-6-methylcyclohexylmethyl) adipate, e.g., "ERL-4289" (obtained from Union Carbide Corp.), dipentene dioxide, e.g., "ERL-4269" (obtained from Union Carbide Corp.) 2-(3,4-epoxycyclohexyl-5,5-spiro-3,4-epoxy)cyclohexanemetadioxane, e.g., "ERL-4234" (obtained from Union Carbide Corp.) and epoxidized polybutadiene, e.g., "Oxiron 2001" (obtained from FMC Corp.)

Other suitable cycloaliphatic epoxides include those described in U.S. Pat. Nos. 2,750,395; 2,890,194; and 3,318,822 which are incorporated herein by reference, and the following:

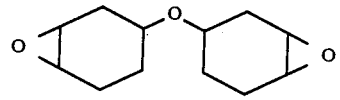

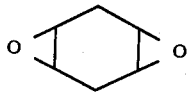

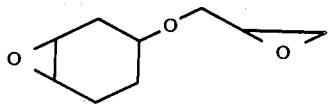

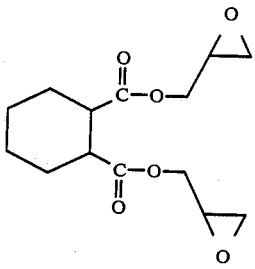

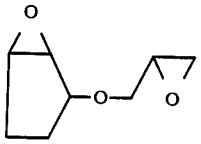

Other suitable epoxides include:

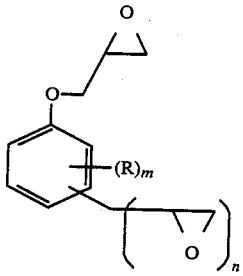

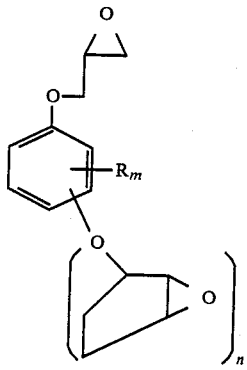

where n is 1 to 4, m is (5-n), and R is H, halogen, or $C_1$ to $C_4$ alkyl.

Reactive diluents containing one epoxide group such as t-butylphenyl glycidyl ether, may also be used. The reactive diluent may comprise up to 25 percent by weight of the epoxide component.

The epoxy resin system may additionally contain an accelerator to increase the rate of cure. Accelerators which may be used herein include Lewis acid:amine complexes such as $BF_3$.monoethylamine, $BF_3$.piperdine, $BF_3$.2-methylimidazole; amines, such as imidazole and its derivatives such as 4-ethyl-2-methylimidazole, 1-methylimidazole, 2-methylimidazole; N,N-dimethylbenzylamine; acid salts of tertiary amines, such as the p-toluene sulfonic acid:imidazole complex, salts of trifluro methane sulfonic acid, such as FC-520 (obtained from 3M Company), organophosphonium halides, dicyandiamide, 1,1-dimethyl-3-phenyl urea (Fikure 62U from Fike Chemical Co.), and chlorinated derivatives of 1,1-dimethyl-3-phenyl urea (monuron and diuron from du Pont). If used, the amount of cure accelerator may be from 0.02 to 10 percent of the weight of the epoxy resin system (i.e., epoxy plus hardener).

In addition to the carbon fibers of this invention, thermoplastic polymers, and cure accelerators, the epoxy resin systems may also contain particulate fillers such as talc, mica, calcium carbonate, aluminum trihydrate, glass microballoons, phenolic thermospheres, pigments, dyes, and carbon black. In prepregs, up to half of the weight of structural fiber in the composition may be replaced by filler. Thixotropic agents such as fumed silica may also be used.

In the epoxy resin systems (i.e. epoxy plus hardener) useful in this invention, the proportion of epoxy resin can be about 95 to about 30 percent by weight, preferably about 80 to about 35 wt. percent, and the proportion of hardener can be from about 5 to about 70 wt. percent, preferably about 15 to about 60 wt. percent.

In prepregs and composites (epoxy plus hardener and structural fiber), the percent by weight of the epoxy resin system can be from about 20 to 80 percent by weight, based on the weight of the prepreg or composite, preferably about 25 to about 60 wt. percent. The carbon fiber comprises 80 to 20 wt. percent, preferably 75 to 40 wt. percent of the total composition.

Although only a few exemplary embodiments of this invention have been described in detail above. those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A method of making carbon fibers, comprising the steps of:

(a) overwrapping a multifilament polyacrylonitrile tow with a 10 to 150 denier thread;

(b) stabilizing said tow by heating in an oxidizing atmosphere at a temperature between about 180° and about 400° C.; and (c) carbonizing the stabilized tow by heating.

2. In a process for the production of carbon fiber wherein a multifilament tow comprising a plurality of polyacrylonitrile fibers is oxidized by heating in an oxidizing atmosphere, then carbonized by heating at an elevated temperature for a time sufficient to carbonize an oxidized polyacrylonitrile fiber, the improvement comprising overwrapping said multifilament tow with at least one 10 to 150 denier thread prior to oxidizing the tow.

3. The process of claim 2 wherein the thread is removed prior to the carbonizing step.

4. The process of claim 2 wherein the thread is selected from cellulosic thread, fiberglass thread, carbon thread and ceramic thread.

5. The process of claim 2 wherein the thread is oxidized and destroyed during the oxidizing step.

* * * * *